US009745809B2

(12) United States Patent
Yi et al.

(10) Patent No.: US 9,745,809 B2
(45) Date of Patent: Aug. 29, 2017

(54) LINER HANGER TOP PACKER

(75) Inventors: Huian Yi, Beijing (CN); Bingzhou Tian, Beijing (CN); Shanyin Chen, Beijing (CN); Baisong Ding, Beijing (CN); Zhien Zan, Beijing (CN); Boren Li, Beijing (CN); Miaoren Liu, Beijing (CN); Fangju Ye, Beijing (CN); Qizun Yi, Beijing (CN); Guangli Chen, Beijing (CN)

(73) Assignees: STARSE ENERGY AND TECHNOLOGY (GROUP) CO., LTD., Beijing (CN); Huian Yi, Beijing (CN)

( * ) Notice: Subject to any disclaimer, the term of this patent is extended or adjusted under 35 U.S.C. 154(b) by 285 days.

(21) Appl. No.: 14/416,600

(22) PCT Filed: Jul. 23, 2012

(86) PCT No.: PCT/CN2012/079051

§ 371 (c)(1),
(2), (4) Date: Jan. 22, 2015

(87) PCT Pub. No.: WO2014/015469

PCT Pub. Date: Jan. 30, 2014

(65) Prior Publication Data

US 2015/0176354 A1 Jun. 25, 2015

(51) Int. Cl.

| | |
|---|---|
| ***E21B 23/06*** | (2006.01) |
| ***E21B 33/12*** | (2006.01) |
| ***E21B 43/10*** | (2006.01) |

(52) U.S. Cl.

CPC ..... *E21B 23/06* (2013.01); *E21B 33/12* (2013.01); *E21B 43/10* (2013.01)

(58) Field of Classification Search

CPC ..... E21B 23/06; E21B 33/12; E21B 43/10
USPC ..... 166/196
See application file for complete search history.

(56) References Cited

U.S. PATENT DOCUMENTS

2010/0038073 A1 2/2010 Carro

FOREIGN PATENT DOCUMENTS

| | | |
|---|---|---|
| CN | 2305482 Y | 1/1999 |
| CN | 2368973 Y | 3/2000 |
| CN | 2620079 Y | 6/2004 |
| CN | 2729299 Y | 9/2005 |

(Continued)

*Primary Examiner* — Taras P Bemko
(74) *Attorney, Agent, or Firm* — Muncy, Geissler, Olds & Lowe, P.C.

(57) ABSTRACT

A liner hanger top packer comprising a body and, an adjusting sleeve, a retaining apparatus, a base-sealing apparatus, a base-hanging apparatus and a locking mechanism sleeved sequentially from top to bottom on the body. The locking mechanism is arranged between the base-sealing apparatus and the base-hanging apparatus. The locking mechanism comprises a locking ball sleeve, a ball socket, and a steel ball. As the lower part of the liner hanger top packer is met with friction, the arrangement of the steel ball restricts relative axial movements between an upper gauge ring of the base-sealing apparatus, the locking ball sleeve, and an upper conical body of the base-hanging apparatus, the friction transmitted to the upper conical body is not transmitted to a lower gauge ring of the base-sealing apparatus, is transmitted to the upper gauge ring via the steel ball, and is transmitted to the adjusting ring via the retaining apparatus.

10 Claims, 7 Drawing Sheets

(56) References Cited

FOREIGN PATENT DOCUMENTS

| | | | |
|---|---|---|---|
| CN | 101555778 | A | 10/2009 |
| GB | 2280461 | A | 2/1995 |

LINER HANGER TOP PACKER

CROSS-REFERENCE TO RELATED APPLICATIONS

This non-provisional application claims priority under 35 U.S.C. §119(a) on PCT Application No. PCT/CN2012/079051 filed in WIPO on Jul. 23, 2012, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The invention relates to a sealing or packoff apparatus within a borehole, in particular to a liner hanger top packer.

BACKGROUND

With the continuous development of the oil well completion technique, the number of some complex wells, such as ultra-deep wells, horizontal wells, extended reach wells, high-pressure wells, is increasing, and the hanging screen well completion technique plays a big role in solving complex problems of the well-completion practice. The liner hanger packer is a key to hanging screen well completion.

According to a product sample introduction published by TIW Corporation (US) in 1997, the product from that company is such a product that a packing segment is arranged at an upper end of a hanging apparatus, the packing segment is sleeved with several plastic cylinders with their lower ends abutting against a shoulder and upper ends pressed by a locking sleeve. The hanging apparatus is in a cylindrical shape with its upper end connecting with a sealing apparatus, and an upper end of the locking sleeve is connected with a tie-back receptacle. During assembly, the locking sleeve and the hanging apparatus is fixed and thus prevented from relative sliding by a pin arranged therebetween, allowing the plastic cylinder to be in an unstressed condition. When descending the well for packing, the tie-back receptacle pushes the locking sleeve downward to shear the pin, and the locking sleeve moves downward to press the plastic cylinder so as to cause radial expansion of the latter, thereby packing an annular space between the liner and an outside casing. A retaining apparatus is arranged below an inner circle of the locking sleeve to allow for a downward movement of the locking sleeve but not a reverse movement, so that the plastic cylinder cannot rebound, and the annular space is effectively packed.

However, such a product has a disadvantage that as the diameter of an outer rim of the plastic cylinder is the same as that of the liner and the locking sleeve, damage occurs when this apparatus descends the well, thereby affecting the packing effect. During a descent process, a premature activation is caused easily, thus leading to accidents.

How to improve the reliability and security of base sealing and base hanging has always been a big problem that manufacturers of liner hanger packers are facing. For many years, many domestic and foreign manufacturers have offered one after another new-type liner hanger packers with unique structures, but due to the influence of the severe downhole environment, premature base-hanging and base-sealing during a descent process of the liner hanger packer has always been a big technical disadvantage in the application of the liner hanger packer.

SUMMARY OF THE INVENTION

The main object of the invention is to provide a liner hanger top packer which can be base-hung more reliably and has an excellent base-sealing performance, thereby allowing a greatly improved base-hanging and base-sealing success rate. Meanwhile, during operation, premature base-hanging and base-sealing will not occur, so that the defect of premature base-hanging and base-sealing of the prior art packer is overcome.

A first aspect of the present invention discloses a liner hanger top packer, the liner hanger top packer comprising a body and, an adjusting sleeve, a retaining apparatus, a base-sealing apparatus, a base-hanging apparatus and a locking mechanism which are sleeved sequentially from top to bottom on the body, wherein, the locking mechanism is arranged between the base-sealing apparatus and the base-hanging apparatus, the locking mechanism comprising: a locking ball sleeve sleeved on the base-sealing apparatus with its upper end abutting against the base-sealing apparatus; a ball socket arranged at a junction of the base-sealing apparatus, the locking ball sleeve and the hanging apparatus, and formed by a first ball socket arranged in the base-sealing apparatus, a second ball socket arranged in the locking ball sleeve and a third ball socket arranged in the base-hanging apparatus which close up facing one another; and a steel ball, arranged in the ball socket for restricting an axial relative movement between the base-sealing apparatus, the locking ball sleeve and the base-hanging apparatus. When the base-sealing apparatus moves downward relative to the body, the steel ball falls into a ring slot in an outer surface of the body, thereby removing the restriction to the axial relative movement between the base-sealing apparatus, the locking ball sleeve and the base-hanging apparatus.

Further, an elastic serrated thread for connecting the base-sealing tool is arranged on the adjusting sleeve of the liner hanger top packer of the invention.

Further, the base-sealing apparatus of the liner hanger top packer of the invention comprises: an upper gauge ring, sleeved on the body and abutting against a step of the body and the retaining apparatus, the upper gauge ring being provided with the first ball socket; a plastic cylinder, sleeved on the upper gauge ring with its upper end abutting against the shoulder of the upper gauge ring; and a lower gauge ring, sleeved on the upper gauge ring and abutting against the lower end of the plastic cylinder and the upper end of the locking ball sleeve.

Further, the upper gauge ring and the lower gauge ring have an outer diameter larger than that of the plastic cylinder. Thus, the plastic cylinder can be prevented from being damaged during tripping, resulting in an effective packing.

Further, the base-hanging apparatus of the liner hanger top packer of the invention comprises: an upper conical body being in screw connection with the lower gauge ring and pressing against the locking ball sleeve, the upper conical body being provided with the third ball socket; a baffle ring, sleeved on the upper conical body; a slip, sleeved on the body and abutting against with the conical surface of the upper conical body and the baffle ring; a slip cage, sleeved outside the slip, the baffle ring and the upper conical body in a connecting way, being in screw connection with the upper conical body, and being in shear pin connection with the baffle ring through the baffle ring; and a lower conical body, sleeved on the body, being fixedly connected with the body and abutting against the slip, wherein when the upper conical body transfers force to the slip, the latter protrude along the conical surface of the lower conical body so as to achieve the base-hanging.

Further, the outer diameter of the lower conical body of the liner hanger top packer of the invention is the maximum outer diameter of the liner hanger top packer. Thus, the plastic cylinder and the slip cage can be protected during tripping.

Further, a longitudinal flow slot is arranged on the surface of the lower conical body of the liner hanger top packer of the invention. Thus, a flow area can be increased.

Further, the retaining apparatus of the liner hanger top packer of the invention comprises: a connecting sleeve sleeved on the body and abutting against the upper gauge ring, wherein the connecting sleeve and the body are in pin connection through a connecting sleeve pin, and when the packer is set, the connecting sleeve pin is sheared; a retaining ring sleeved on the body and abutting against the connecting sleeve, ratchets arranged on the inner surface of the retaining ring matching with that of the body to prevent the retaining ring from moving upward relative to the body; and a base-sealing sleeve sleeved on the body and abutting against the connecting sleeve and the retaining ring, the base-sealing sleeve and the connecting sleeve being connected by a countersunk screw.

Further, the adjusting sleeve and the base-sealing sleeve of the liner hanger top packer of the invention are fixed by an anti-rotational screw, and a fixed hole formed in the adjusting sleeve is a long hole.

Further, a seal is provided between the connecting sleeve and the body, between the upper gauge ring and the body, as well as between the lower gauge ring and the upper gauge ring of the liner hanger top packer of the invention respectively by a seal ring.

Hereinafter, the invention is described in detail with reference to the accompanying drawings and embodiments, which, however, are not to limit the invention.

DESCRIPTION OF THE DRAWING REFERENCE SIGNS

Figure 1:
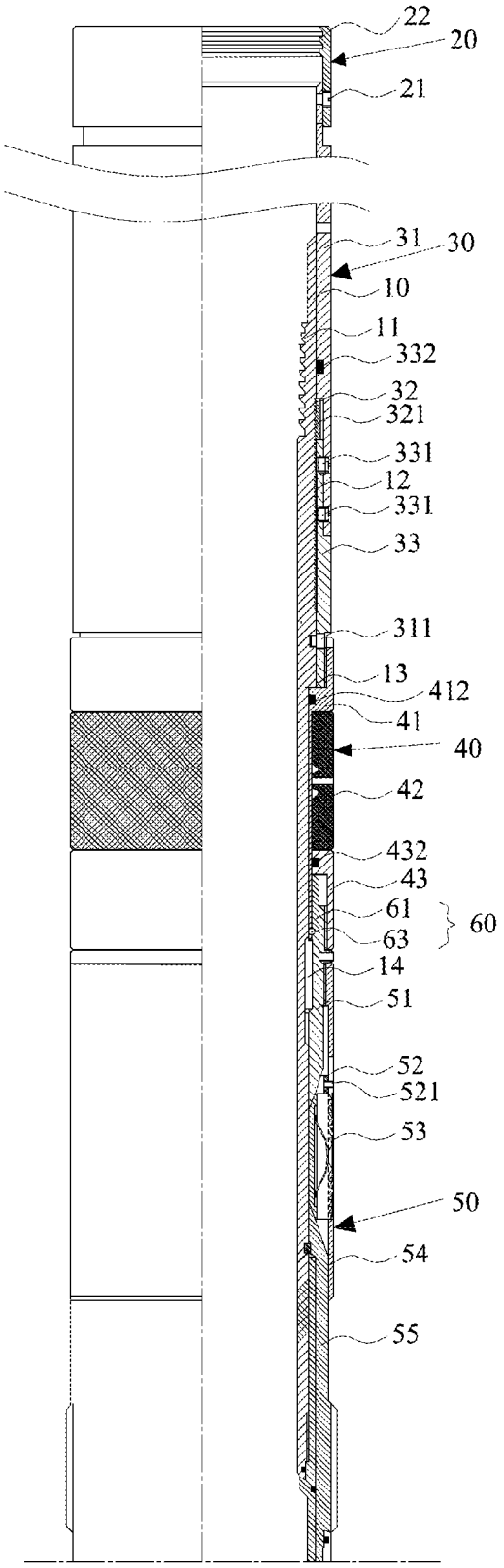
FIG. 1 is a schematic diagram of a structure of a liner hanger top packer of the invention (the right half being a cross-section schematic view)
Figure 2:
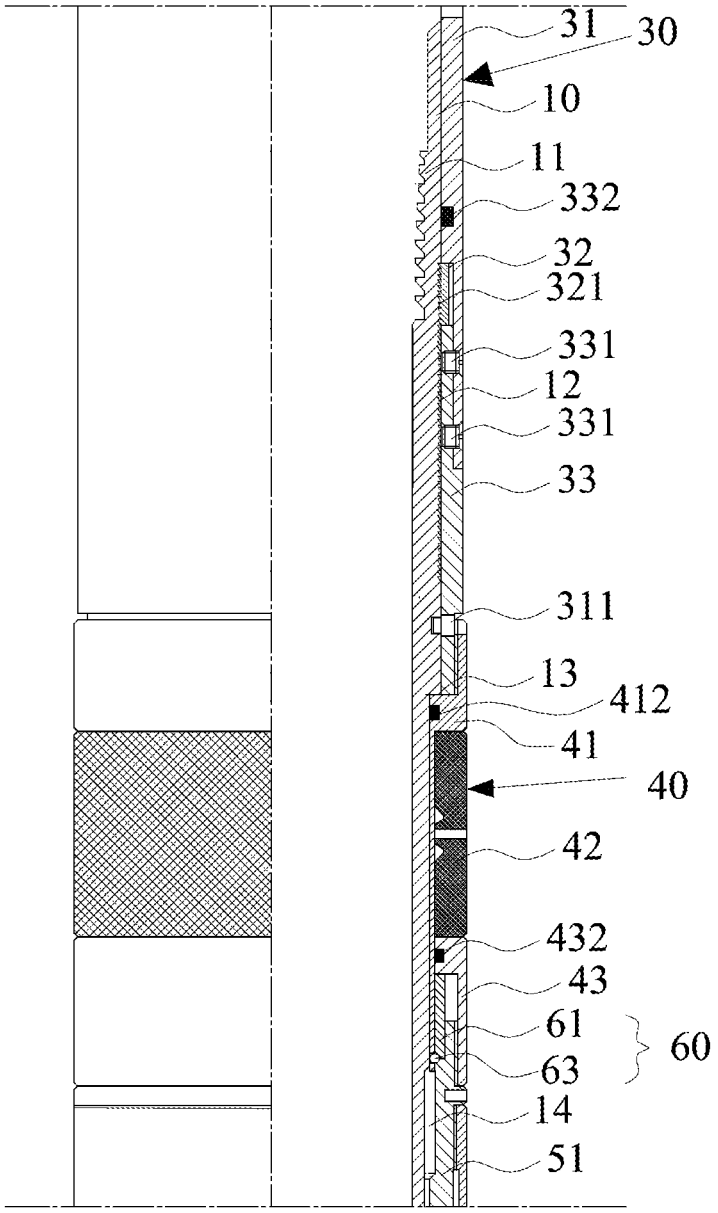
FIG. 2 is an enlarged schematic diagram of a structure of a part provided with a body of the liner hanger top packer of the invention (the right half being a cross-section schematic view)

Body 10
Serrated thread 11
Ratchet 12
Step 13
Ring slot 14
Adjusting sleeve 20
Anti-rotational screw 21
Serrated thread 22
Retaining apparatus 30
Connecting sleeve 31
Connecting sleeve pin 311
Retaining ring 32
Ratchet 321
Base-sealing sleeve 33
Countersunk screw 331
Seal ring 332
Base-sealing apparatus 40
Upper gauge ring 41
Seal ring 412
First ball socket 413
Plastic cylinder 42
Lower gauge ring 43
Seal ring 432
Base-hanging apparatus 50
Upper conical body 51
Third ball socket 513
Baffle ring 52
Baffle ring shear pin 521
Slip 53
Slip cage 54
Lower conical body 55
Locking mechanism 60
Locking ball sleeve 61
Second ball socket 613
Ball socket 62
Steel ball 63

DESCRIPTION OF THE PREFERRED EMBODIMENTS

Hereinafter, the structure principle and operating principle of the present invention are described in detail with reference to the accompanying drawings.

Referring to FIG. 1, the liner hanger top packer of the invention comprises a body 10 and, an adjusting sleeve 20, a retaining apparatus 30, a base-sealing apparatus 40, a base-hanging apparatus 50 and a locking mechanism 60 which are sleeved sequentially from top to bottom on the body 10. Wherein, the locking mechanism 60 arranged between the base-sealing apparatus 40 and the base-hanging apparatus 50.

Referring to FIGS. 1 to 6, the body 10 is a tubular body with a serrated thread 11 arranged on its inner surface for connecting with a service tool, its outer surface is provided with ratchets 12 for preventing the retaining apparatus 30 from moving upward relative to the body 10. The outer surface of the body 10 includes a step 13, which includes an upper part and a lower part. The outer diameter of the upper part is greater than the outer diameter of the lower part. The base-sealing apparatus 40 is stuck below the step 13 so as to prevent the base-sealing apparatus 40 from moving upward relative to the body 10. The outer surface of the body 10 includes a ring slot 14, which is positioned below the step 13 along an outer wall of the body 10.

Figure 3:
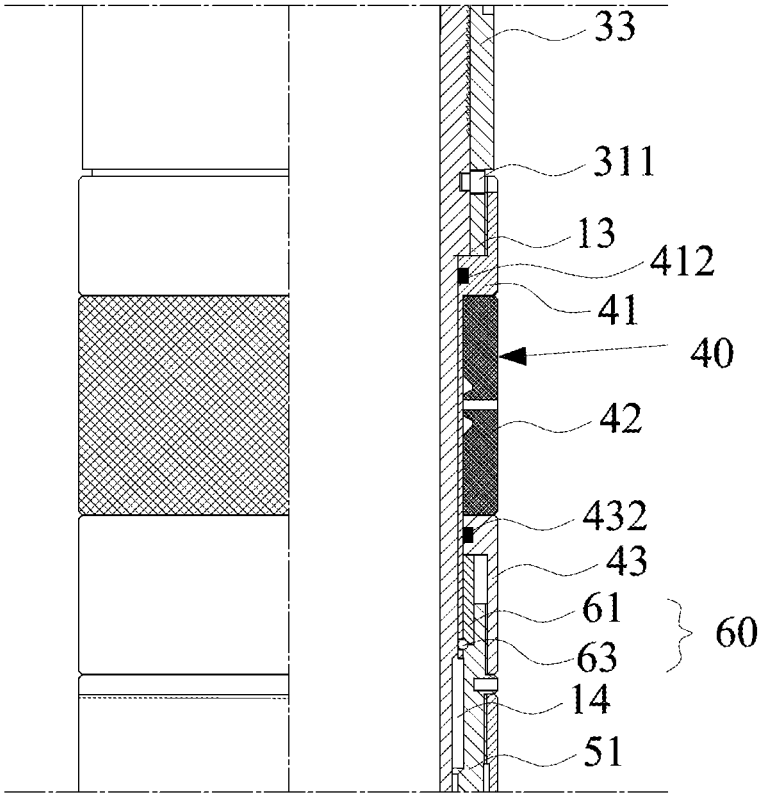
FIG. 3 is an enlarged schematic diagram of a structure of a part provided with a base-sealing apparatus of the liner hanger top packer of the invention (the right half being a cross-section schematic view)

Referring to FIGS. 1 and 3, the base-sealing apparatus 40 comprises: an upper gauge ring 41 sleeved on the body 10 and abutting against the step 13 of the body 10, thus being restricted from moving upward relative to the body 10, wherein a seal between the upper gauge ring 41 and the body 10 is provided by a seal ring 412; a plastic cylinder 42 sleeves on the upper gauge ring 41 and abuts the shoulder of the upper gauge ring 41; and a lower gauge ring 43 sleeved on the upper gauge ring 41 and abutting against the lower end of the plastic cylinder, wherein a seal between the lower gauge ring 43 and the upper gauge ring 41 is provided by a seal ring 432.

Figure 4:
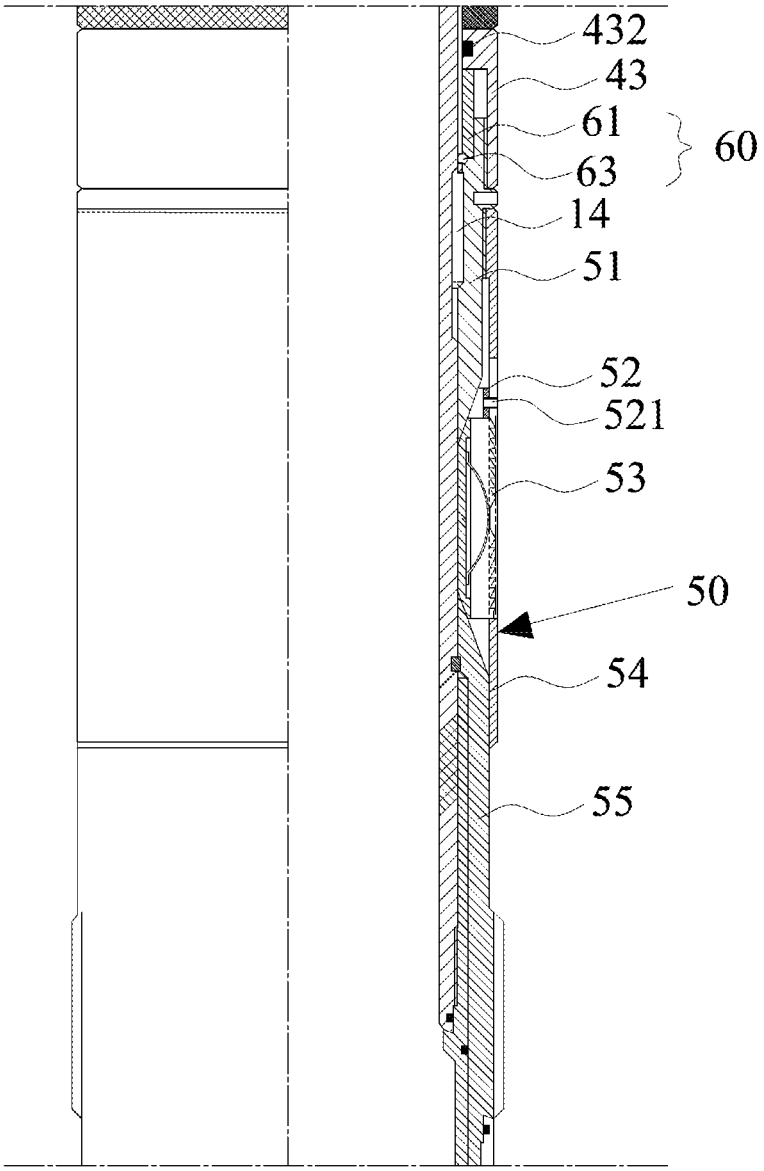
FIG. 4 is an enlarged schematic diagram of a structure of a part provided with a base-hanging apparatus of the liner hanger top packer of the invention (the right half being a cross-section schematic view)

Referring to FIGS. 1 and 4, the base-hanging apparatus 50 comprises: an upper conical body 51 sleeved on the body 10 and being in screw connection with the lower gauge ring 43; a baffle ring 52 sleeved on the upper conical body 51; a slip 53 sleeved on the body 10 with its upper end abutting against the conical surface of the upper conical body 51 and the baffle ring 52, an outer wall of the slip 53 being provided with barbs; a slip cage 54 sleeved outside the slip 53, the baffle ring 52 and the upper conical body 51 in a connecting way, integrally connected to the upper conical body 51 through screw connection, and being in pin connection with a baffle ring shear pin 521 through the baffle ring 52, wherein an opening is formed on the slip cage 54 for the slip 53 to protrude; and a lower conical body 55 sleeved on the body 10, fixedly connected with the body 10 and abutting against the lower end of the slip 53.

Figure 5:
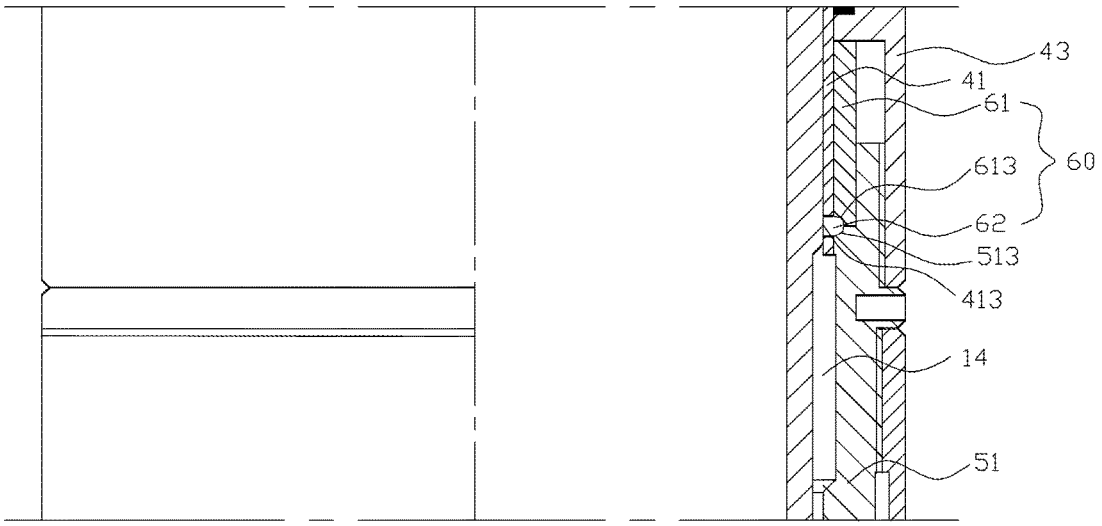
FIG. 5 is an enlarged schematic diagram of a structure of a part provided with a locking mechanism apparatus of the liner hanger top packer of the invention (the right half being a cross-section schematic view with a steel ball removed)

Referring to FIGS. 3 to 5, the locking mechanism 60 comprises: a locking ball sleeve 61 sleeved on a base-sealing apparatus 40, its upper end pressing against the base-sealing apparatus 40, more specifically, the locking ball sleeve 61 being sleeved on the upper gauge ring 41 of the base-sealing apparatus 40, and the upper end of the locking ball sleeve 61 pressing against the lower gauge ring 43 of the base-sealing apparatus 40; a ball socket 62 arranged at a junction of the base-sealing apparatus 40, the locking ball sleeve 61 and the base-hanging apparatus 50, and formed by a first ball socket 413 arranged in the base-sealing apparatus 40, a second ball socket 613 arranged in the locking ball sleeve 61 and a third ball socket 513 arranged in the base-hanging apparatus 50 which close up facing one another, wherein more specifically, the ball socket 62 is arranged at the junction of the upper gauge ring 41 of the base-sealing apparatus 40, the locking ball sleeve 61 and the upper conical body 51 of the base-hanging apparatus 50, and is formed by the first ball socket 413 arranged in the upper gauge ring 41 of the base-sealing apparatus 40, the second ball socket 613 arranged in the locking ball sleeve 61 and the third ball socket 513 arranged in the upper conical body 51 of the base-hanging apparatus 50 which close up facing one another; and a steel ball 63 arranged in the ball socket 62 to restrict the axial relative movement between the base-sealing apparatus 40, the locking ball sleeve 61 and the base-hanging apparatus 50, wherein when the base-sealing apparatus 40 moves downward relative to the body 10, the steel ball 63 falls into the ring slot 14 in the outer surface of the body 10, thereby removing the restriction to the axial relative movement between the upper gauge ring 41 of the base-sealing apparatus 40, the locking ball sleeve 61 and the upper conical body 51 of the base-hanging apparatus 50.

Figure 6:
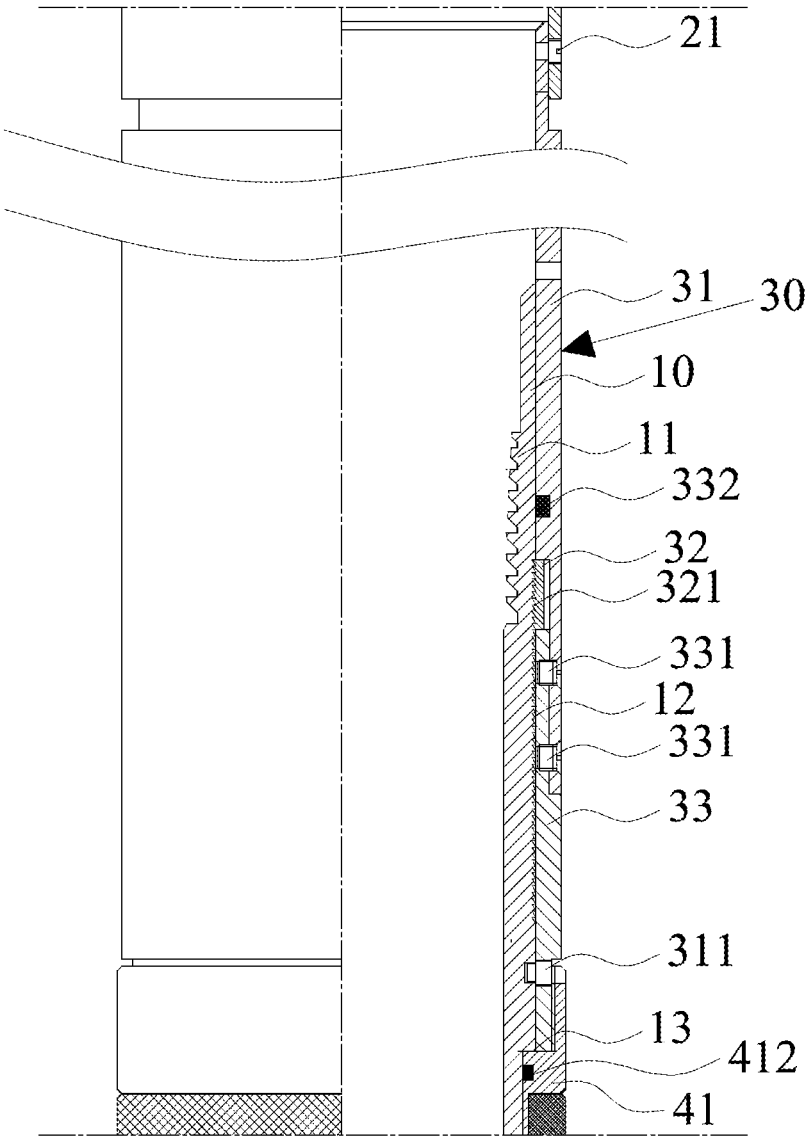
FIG. 6 is an enlarged schematic diagram of a structure of a part provided with a retaining apparatus of the liner hanger top packer of the invention (the right half being a cross-section schematic view)

Referring to FIGS. 1 and 6, the retaining apparatus 30 comprises: a connecting sleeve 31 sleeved on the body 10 and abutting against the upper gauge ring 41, the connecting sleeve 31 and the body 10 being in pin connection through a connecting sleeve pin 311; a retaining ring 32 sleeved on the body 10 and abutting against the connecting sleeve 31, the inner surface of the retaining ring 32 being provided with ratchets 321 which match with the ratchets 12 of the body 10 to prevent the retaining ring 32 from moving upward relative to the body 10; and a base-sealing sleeve 33 sleeved on the body 10 and abutting against the connecting sleeve 31 and the retaining ring 32, the base-sealing sleeve 33 and the connecting sleeve 31 being connected through a countersunk screw 331, and a seal between the base-sealing sleeve 33 and the body 10 being provided by a seal ring 332.

Figure 7:
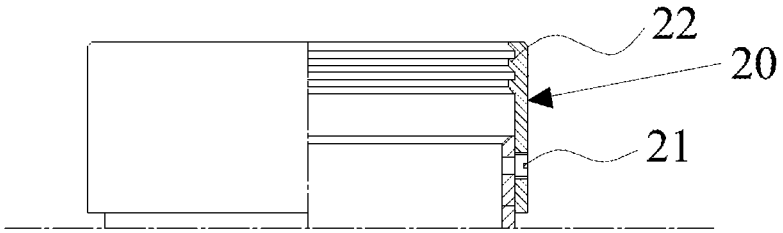
FIG. 7 is an enlarged schematic diagram of a structure of a part provided with an adjusting sleeve of the liner hanger top packer of the invention (the right half being a cross-section schematic view).

Referring to FIGS. 1 and 7, the adjusting sleeve 20 is sleeved on the base-sealing sleeve 33, the adjusting sleeve 20 and the base-sealing sleeve 33 are fixed by the anti-rotational screw 21, and an elastic serrated thread 22 for connecting the base-sealing tool is arranged on the adjusting sleeve 20. A fixing hole formed on the adjusting sleeve 20 for fixing the anti-rotational screw is preferably a long hole so as to adjust the relative position between the base-sealing sleeve 33 and the adjusting sleeve 20 and facilitate the assembly.

The plastic cylinder 42 and the lower gauge ring 43 are sleeved on the upper gauge ring 41 of the liner hanger top packer of the invention, and the upper gauge ring 41 is integrally connected with the steel ball 63 by the locking ball sleeve 61. During a descent process, the lower part of the liner hanger top packer of the invention is met with friction, since the steel ball 63 restricts the axial relative movement between the upper gauge ring 41, the locking ball sleeve 61 and the upper conical body 51, the resistance transferred to the upper conical body 51 will not be transferred to the lower gauge ring 43, but is directly transferred to the upper gauge ring 41 through the steel ball 63 and is further transferred to the adjusting sleeve 20 through the retaining apparatus 30. Thus, relative movement between the upper gauge ring 41 and the lower gauge ring 43 will not be produced during a descent process, and the plastic cylinder 42 does not deform, thereby preventing the possibility of premature base-sealing.

After the completion of the descent process, drilling and completion fluid is driven into a central string, and a piston mechanism 25 in a running service tool is connected with the adjusting sleeve 20 through the serrated thread 22. As the serrated thread 22 is elastic, the piston mechanism disengages from the adjusting sleeve 20 under pressure of the drilling and completion fluid and continues to move axially downward, driving the base-sealing sleeve 33 to have a certain downward axial displacement. After the connecting sleeve pin 311 is sheared completely, the upper gauge ring 41 will be urged to move, thereby making the steel ball 63 fall into the ring slot 14 of the body 10. Then, the resistance is no longer transferred to the upper conical body 51 through the steel ball 63, but to the plastic cylinder 42. The plastic cylinder 42 is pressed and undergoes a radial elastic deformation, causing the gap between an inner string and an outer string to be completely filled and sealed, thereby realizing the base-sealing. Axial displacement occurs when the plastic cylinder 42 expands radically, and after shearing a next stop pin baffle ring shear pin 521, the plastic cylinder 42 urges the slip cage 54 and the upper conical body 51 to make axial movement at the same time. As the lower conical body 55 has already been fixed to the body 10, the upper conical body 51 and the lower conical body 55 will move toward each other, thereby unlocking the slip 53 to allow it to move downward along the conical surface of the lower conical body 55 and protrude radically. Then, barbs on the slip 53 may be used to clip the inner wall of the outer string, thereby realizing the base-hanging.

In other preferred embodiments of the invention, the outer diameter of a lower conical body 55 may be set to be the maximum outer diameter of the liner hanger top packer so as to protect the plastic cylinder 42 and the slip cage 54 during tripping. Or, longitudinal flow slots may be formed on the surface of the lower conical body to increase flow area. The outer diameter of the upper gauge ring 41 and the lower gauge ring 43 may also be set to be greater than the outer diameter of the 42, thus the plastic cylinder 42 can be protected from being damaged during tripping, thereby accomplishing the packing effectively.

In addition, the present invention may have a variety of other embodiments. Those skilled in the art can make all kinds of corresponding changes and modifications according to the present invention without departing from the spirit and essence of the present invention. It is intended that all these changes and modifications be covered by the appended claims of the present invention.

INDUSTRIAL APPLICABILITY

The upper gauge ring of the liner hanger top packer of the invention is sleeved with the plastic cylinder and the lower gauge ring, and integrally connects with the steel ball through the locking ball sleeve. During a descent process, the lower part of the liner hanger top packer of the invention is met with friction, since the steel ball restricts the axial relative movement between the upper gauge ring, the locking ball sleeve and the upper conical body, the friction transmitted to the upper conical body is not transmitted to the lower gauge ring, but is directly transmitted directly to the upper gauge ring via the steel ball and is further transmitted to the adjusting sleeve via the retaining apparatus. As such, relative movements are not generated between the upper gauge ring and the lower gauge ring, while a plastic cylinder does not deform, thus preventing the possibility to premature base-sealing.

What is claimed is:

1. A liner hanger top packer, comprising a body, wherein the liner hanger top packer further comprises an adjusting sleeve, a retaining apparatus, a base-sealing apparatus, a base-hanging apparatus and a locking mechanism which are sleeved sequentially from top to bottom on the body, wherein, the locking mechanism is arranged between the base-sealing apparatus and the base-hanging apparatus, the locking mechanism comprising:

a locking ball sleeve sleeved on the base-sealing apparatus with an upper end abutting against the base-sealing apparatus;

a ball socket arranged at a junction of the base-sealing apparatus, the locking ball sleeve and the base-hanging apparatus, and which is formed of a first ball socket arranged in the base-sealing apparatus, a second ball socket arranged in the locking ball sleeve and a third ball socket arranged in the base-hanging apparatus; and a steel ball arranged in the ball socket to restrict the axial relative movement between the base-sealing apparatus, the locking ball sleeve and the base-hanging apparatus, wherein when the base-sealing apparatus moves downward relative to the body, the steel ball falls into a ring slot in an outer surface of the body, thereby removing the restriction to the axial relative movement between the base-sealing apparatus, the locking ball sleeve and the base-hanging apparatus.

2. The liner hanger top packer according to claim 1, wherein the base-sealing apparatus comprises:

an upper gauge ring sleeved on the body and abutting against a step of the body and the retaining apparatus, wherein the upper gauge ring is provided with the first ball socket;

a plastic cylinder sleeved on the upper gauge ring with an upper end abutting against the shoulder of the upper gauge ring; and a lower gauge ring sleeved on the upper gauge ring and abutting against the lower end of the plastic cylinder and the upper end of the locking ball sleeve.

3. The liner hanger top packer according to claim 2, wherein an outer diameter of the upper gauge ring and the lower gauge ring are greater than the outer diameter of the plastic cylinder.

4. The liner hanger top packer according to claim 2, wherein the base-hanging apparatus comprises:

an upper conical body provided with the third ball socket, which is in screw connection with the lower gauge ring and presses against the locking ball sleeve;

a baffle ring sleeved on the upper conical body;

a slip sleeved on the body and abutting against the conical surface of the upper conical body and the baffle ring;

a slip cage sleeved outside the slip, the baffle ring and the upper conical body, which is in screw connection with the upper conical body, and which is in pin connection with the baffle ring through a baffle ring shear pin; and a lower conical body sleeved on the body, which is fixedly connected with the body and which abuts against the slip, wherein when the upper conical body transfers force to the slip, the slip protrudes along the conical surface of the lower conical body so as to achieve the base-hanging.

5. The liner hanger top packer according to claim 4, wherein an outer diameter of the lower gauge ring is the maximum outer diameter of the liner hanger top packer.

6. The liner hanger top packer according to claim 4, wherein a longitudinal flow slot is formed in a surface of the lower conical body.

7. The liner hanger top packer according to claim 2, wherein the retaining apparatus comprises:

a connecting sleeve sleeved on the body and abutting against the upper gauge ring, wherein the connecting sleeve and the body are in pin connection through a connecting sleeve pin, and when the packer is set, the connecting sleeve pin is sheared;

a retaining ring sleeved on the body and abutting against the connecting sleeve, wherein ratchets arranged on an inner surface of the retaining ring match with ratchets of the body to prevent the retaining ring from moving upward relative to the body; and a base-sealing sleeve sleeved on the body and abutting against the connecting sleeve and the retaining ring, the base-sealing sleeve and the connecting sleeve being connected by a countersunk screw.

8. The liner hanger top packer according to claim 7, wherein the adjusting sleeve and the base-sealing sleeve are fixed by an anti-rotational screw, and a fixed hole formed in the adjusting sleeve is an elongate hole.

9. The liner hanger top packer according to claim 7, wherein a seal is provided between the connecting sleeve and the body.

10. The liner hanger top packer according to claim 2, wherein a seal is provided between the upper gauge ring and the body, as well as between the lower gauge ring and the upper gauge ring by a seal ring.

* * * * *